US011454923B2

(12) United States Patent
Ooka

(10) Patent No.: US 11,454,923 B2
(45) Date of Patent: Sep. 27, 2022

(54) DEVELOPING CARTRIDGE INCLUDING CAM MOVABLE RELATIVE TO CASING BETWEEN FIRST POSITION AND SECOND POSITION

(71) Applicant: BROTHER KOGYO KABUSHIKI KAISHA, Nagoya (JP)

(72) Inventor: Kazuaki Ooka, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/381,281

(22) Filed: Jul. 21, 2021

(65) Prior Publication Data

US 2021/0349421 A1 Nov. 11, 2021

Related U.S. Application Data

(63) Continuation of application No. PCT/JP2020/005458, filed on Feb. 13, 2020.

(30) Foreign Application Priority Data

Mar. 28, 2019 (JP) ..... JP2019-063302

(51) Int. Cl.
*G03G 21/16* (2006.01)
*G03G 21/18* (2006.01)

(52) U.S. Cl.
CPC ..... *G03G 21/1676* (2013.01); *G03G 21/1647* (2013.01); *G03G 21/1821* (2013.01); (Continued)

(58) Field of Classification Search
CPC ..... G03G 21/1647; G03G 21/1676; G03G 21/1821; G03G 21/1825; G03G 21/1842; G03G 21/1864; G03G 2221/1678
See application file for complete search history.

(56) References Cited

U.S. PATENT DOCUMENTS

2011/0064457 A1 3/2011 Okabe et al.
2011/0222903 A1 9/2011 Kishi
(Continued)

FOREIGN PATENT DOCUMENTS

JP 10-222042 A 8/1998
JP 2011-59510 A 3/2011
WO 2019/187234 A1 3/2019

OTHER PUBLICATIONS

International Search Report and Written Opinion issued in PCT/JP2020/005458, dated Mar. 10, 2020.

*Primary Examiner* — Sophia S Chen
(74) *Attorney, Agent, or Firm* — Merchant & Gould P.C.

(57) ABSTRACT

A developing cartridge includes a developing roller, a casing, and a cam. The developing roller is configured to be positioned at a contact position where the developing roller is in contact with a photosensitive drum of a drum cartridge. The developing roller is also configured to be positioned at a separated position where the developing roller is separated from the photosensitive drum. The cam is movable relative to the casing between a first position and a second position. A portion of the developing cartridge is in contact with the drum cartridge and functions as a pivot center so that the casing and the developing roller are pivotally moved about the pivot center when the cam is moved from the first position to the second position.

26 Claims, 14 Drawing Sheets

(52) U.S. Cl.
CPC ..... *G03G 21/1825* (2013.01); *G03G 21/1864* (2013.01); *G03G 2221/1678* (2013.01)

(56) References Cited

U.S. PATENT DOCUMENTS

| | | | | |
|---|---|---|---|---|
| 2013/0322918 | A1 | 12/2013 | Igarashi et al. | |
| 2016/0252877 | A1 | 9/2016 | Nakamura et al. | |
| 2019/0302682 | A1 * | 10/2019 | Wang ..... | G03G 21/1821 |

* cited by examiner

DEVELOPING CARTRIDGE INCLUDING CAM MOVABLE RELATIVE TO CASING BETWEEN FIRST POSITION AND SECOND POSITION

CROSS REFERENCE TO RELATED APPLICATION

This is a by-pass continuation application of International Application No. PCT/JP2020/005458 filed Feb. 13, 2020 claiming priority from Japanese Patent Application No. 2019-063302 filed Mar. 28, 2019. The entire contents of the International Application and the priority application are incorporated therein by reference.

TECHNICAL FIELD

The present invention relates to a developing cartridge.

BACKGROUND

Conventionally, there is known an electro-photographic type image forming apparatus such as a laser printer and an LED printer. The image forming apparatus includes a developing cartridge. The developing cartridge includes a developing roller for supplying developing agent. One conventional image forming apparatus is described in a prior art, for example. The image forming apparatus described in the prior art includes a drum cartridge including a photosensitive drum. The developing cartridge is attached to the drum cartridge. Upon attachment of the developing cartridge to the drum cartridge, the photosensitive drum and the developing roller contact with each other.

SUMMARY

The image forming apparatus according to the prior art is switchable between a state where the developing roller and the photosensitive drum contact with each other and a state where the developing roller and the photosensitive drum are separated from each other. In the image forming apparatus disclosed in the prior art, components for moving the developing cartridge to separate the developing roller and the photosensitive drum away from each other are provided at each side of a drum cartridge. Therefore, the components at each side need to receive driving force from a main body of the image forming apparatus.

In view of the foregoing, it is an object of the present disclosure to provide a developing cartridge capable of moving a developing roller away from a photosensitive drum due to a driving force applied to only one side without necessitating application of a driving force to both sides.

In order to attain the above and other objects, according to one aspect, the present disclosure provides a developing cartridge attachable to a drum cartridge including a photosensitive drum. The developing cartridge includes a developing roller, a casing and a cam. The developing roller is rotatable about a first axis extending in a first direction. The developing roller is configured to be positioned at a contact position where the developing roller is in contact with the photosensitive drum. The developing roller is also configured to be positioned at a separated position where the developing roller is separated from the photosensitive drum. The casing is configured to accommodate therein developing agent. The cam is movable relative to the casing between a first position and a second position in the first direction. The second position is a position further in a direction from one side toward another side in the first direction than the first position. The cam has a sloped surface sloping with respect to the first direction. In a state of attachment of the developing cartridge to the drum cartridge, the developing roller is positioned at the contact position at the first position of the cam. A portion of the developing cartridge is in contact with the drum cartridge and functions as a pivot center so that the casing and the developing roller are pivotally moved about the pivot center when the cam is moved from the first position to the second position. In the state of attachment of the developing cartridge to the drum cartridge, the developing roller is positioned at the separated position at the second position of the cam.

BRIEF DESCRIPTION OF THE DRAWINGS

The particular features and advantages of the disclosure will become apparent from the following description taken in connection with the accompanying drawings, in which.

DETAILED DESCRIPTION

Hereinafter, a developing cartridge 1 according to one embodiment of the present disclosure will be described while referring to the accompanying drawings.

In the following description, a direction in which a rotational axis of a developing roller 20 (a first axis) extends will be referred to as "first direction". Here, an outer circumferential surface of the developing roller 20 includes a portion exposed to the outside of a casing 10 of the developing cartridge 1, and another portion positioned inside the casing 10. A direction in which the portion of the circumferential surface of the developing roller 20 and the other portion of the circumferential surface of the developing roller 20 are arrayed will be referred to as "second direction". The second direction also denotes a direction crossing the circumferential surface of the developing roller 20 which is exposed to the outside of the casing 10 of the developing cartridge 1. The second direction may denote a direction in which the outer circumferential surface of the developing roller 20 is separated from and/or approaches an outer circumferential surface of a photosensitive drum 201. The first direction and the second direction cross each other. Preferably, the first direction and the second direction are perpendicular to each other. Further, a direction crossing both the first direction and the second direction will be referred to as "third direction". Preferably, the third direction is perpendicular to both the first direction and the second direction.

<1. Overall Configuration of Image Forming Apparatus>

Figure 1:
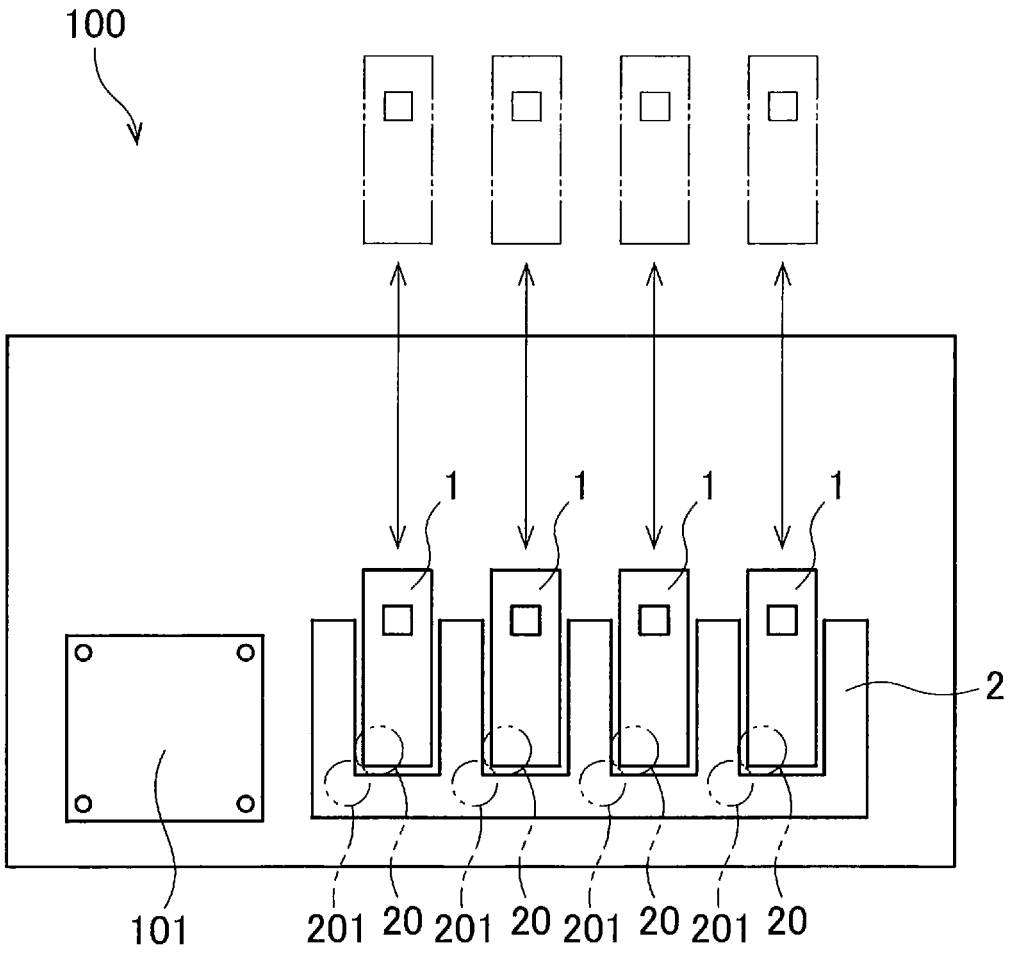
FIG. 1 is a schematic diagram of an image forming apparatus including a drum cartridge and developing cartridges according to one embodiment of the present disclosure.

FIG. 1 is a schematic diagram of an image forming apparatus 100. The image forming apparatus 100 is an electro-photographic type printer such as a laser printer and an LED printer. As illustrated in FIG. 1, the image forming apparatus 100 includes four developing cartridges 1, a dram cartridge 2, and a controller 101. The four developing cartridges 1 are attachable to and detachable from the drum cartridge 2. The drum cartridge 2 to which four developing cartridges 1 are attached is attachable to and detachable from the image forming apparatus 100. The four developing cartridges 1 accommodate therein developing agents of different colors (for example, cyan, magenta, yellow and black). The controller 101 is configured to control each unit in the image forming apparatus 100 in accordance with a computer program stored in advance. The image forming apparatus 100 is configured to form an image on a printing sheet with the developing agents (toners) supplied from the four developing cartridges.

<2. Overall Configuration of Drum Cartridge>

Figure 2:
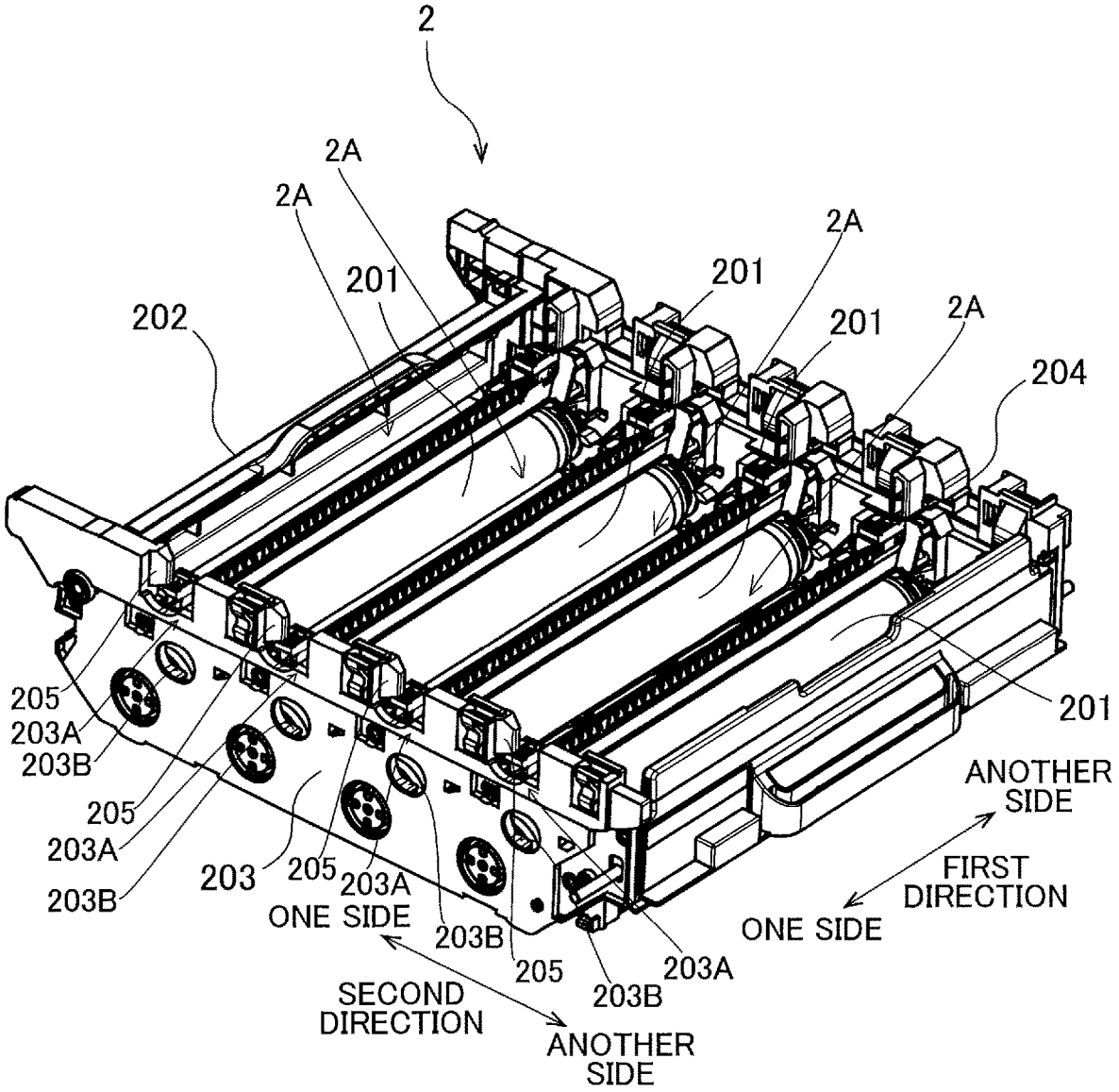
FIG. 2 is a perspective view of the drum cartridge in which no developing cartridge is attached.

FIG. 2 is a perspective view of the drum cartridge 2. As illustrated in FIG. 2, the drum cartridge 2 includes four photosensitive drums 201, and a drum frame 202.

The four photosensitive drums 201 are arrayed in the second direction with a space between neighboring drums. Each photosensitive drum 201 is rotatable about a rotation axis extending in the first direction. The photosensitive drum 201 has a cylindrical outer peripheral surface centered on the rotation axis. The outer circumferential surface is coated with photosensitive material. The four photosensitive drums 201 are rotatably supported by the drum frame 202.

The drum frame 202 includes a first side frame 203 and a second side frame 204. The first side frame 203 and the second side frame 204 face each other in the first direction. The first side frame 203 and the second side frame 204 extend in a direction perpendicular to the first direction. The first side frame 203 rotatably supports one end portion in the first direction of each photosensitive drum 201. The second side frame 204 rotatably supports another end portion in the first direction of each photosensitive drum 201.

The developing cartridge 1 is attachable to and detachable from the drum frame 202 of the drum cartridge 2. In the depicted embodiment, four developing cartridges 1 are attachable to and detachable from the drum frame 202. Further, the number of developing cartridges may be from one to three or not less than five. Upon attachment of the developing cartridge 1 to the drum frame 202, the developing roller 20 contacts the photosensitive drum 201.

As shown in FIG. 2, the drum frame 202 includes four slots 2A. The developing cartridge 1 are respectively attachable to the corresponding slots 2A. Each of the photosensitive drums 201 is rotatable about the rotational axis (the drum axis) extending in the first direction. Each of the developing cartridge 1 is attachable to the corresponding slot 2A of the drum cartridge 2 such that the outer circumferential surface of the developing roller 20 faces the outer circumferential surface of the photosensitive drum 201. The drum cartridge 2 to which the developing cartridge 1 has been attached to each slot 2A is attached to the image forming apparatus 100.

When the developing cartridges 1 are attached to the slots 2A, the developing cartridges 1 are positioned between the first side frame 203 and the second side frame 204 in the first direction. In this state, the one end portion of each developing cartridge 1 faces the first side frame 203 in the first direction, and the other end portion of each developing cartridge 1 faces the second side frame 204 in the first direction.

The first side frame has recessed portions 203A. Each recessed portion 203A is formed corresponding to each slot 2A. Each of the recessed portions 203A penetrates the first side frame 203 in the first direction to expose a portion of the developing cartridge 1 to the outside of the drum cartridge 2, and is open toward a direction away from the corresponding photosensitive drum 201 in the third direction. In a state where each developing cartridge 1 is attached to the corresponding slot 2A of the drum cartridge 2, a cam 60 (described later) of each developing cartridge 1 is positioned in the corresponding recessed portions 203A, as illustrated in FIGS. 7 and 9.

The first side frame 203 further has through-holes 203B. Each through-holes 203B is formed corresponding to each of the slots 2A. Each of the through-holes 203B penetrates the first side frame 203 in the first direction. In a state where each developing cartridge 1 is attached to the corresponding slot 2A of the drum cartridge 2, a fixing hole 521 of a coupling 52 (described later) of each developing cartridge 1 is exposed from the corresponding through-hole 203B. A transmission shaft (not shown) of the image forming apparatus 100 is inserted into each fixing hole 521 through the corresponding through-hole 203B so that the transmission shafts are coupled with the coupling 52 so as not to rotate relative to each other.

Figure 7:
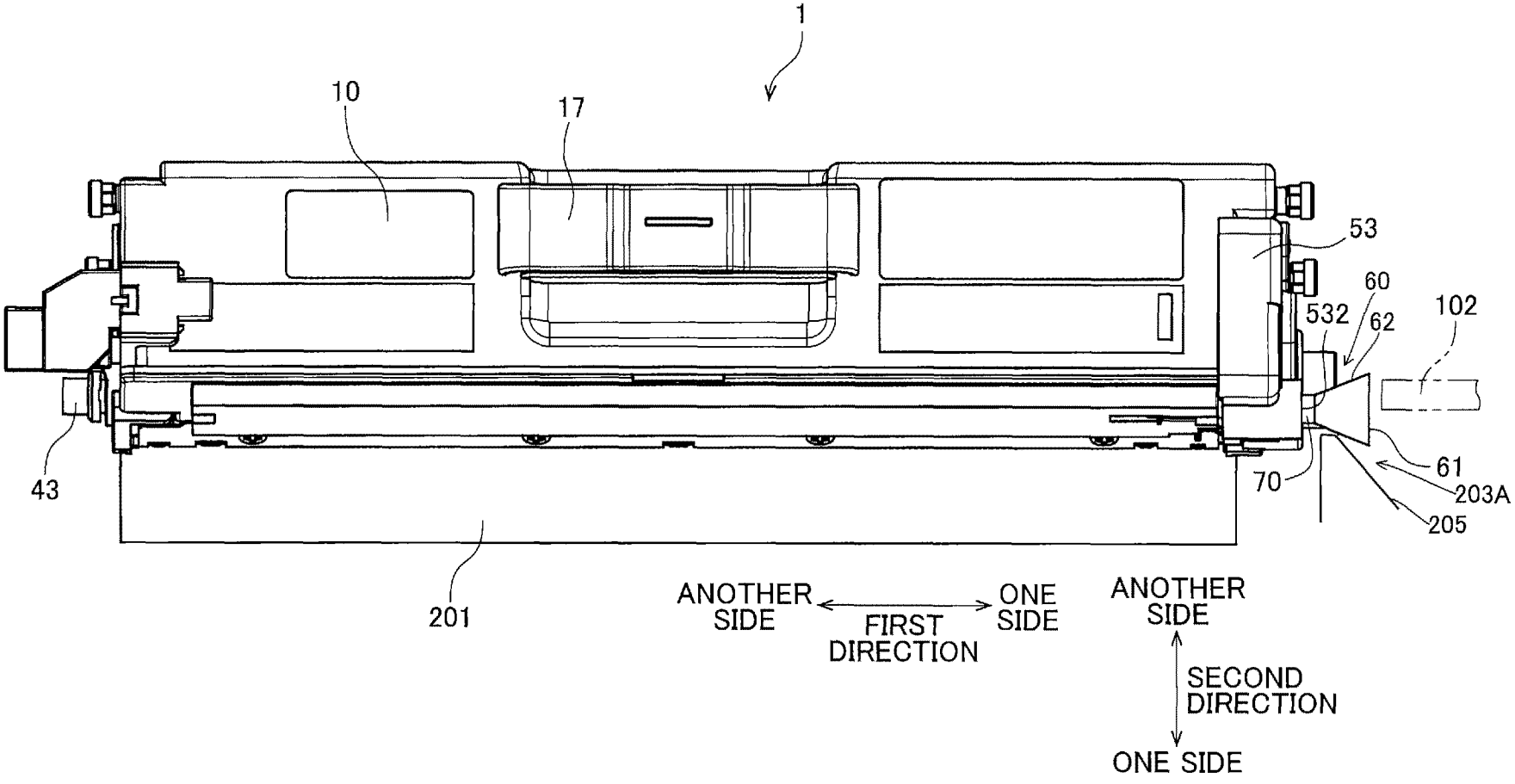
FIG. 7 is a view of the developing cartridge according to the embodiment and the photosensitive drum as viewed in a direction from another side toward one side in a third direction, in the state where the developing cartridge is at the contacting position.
Figure 9:
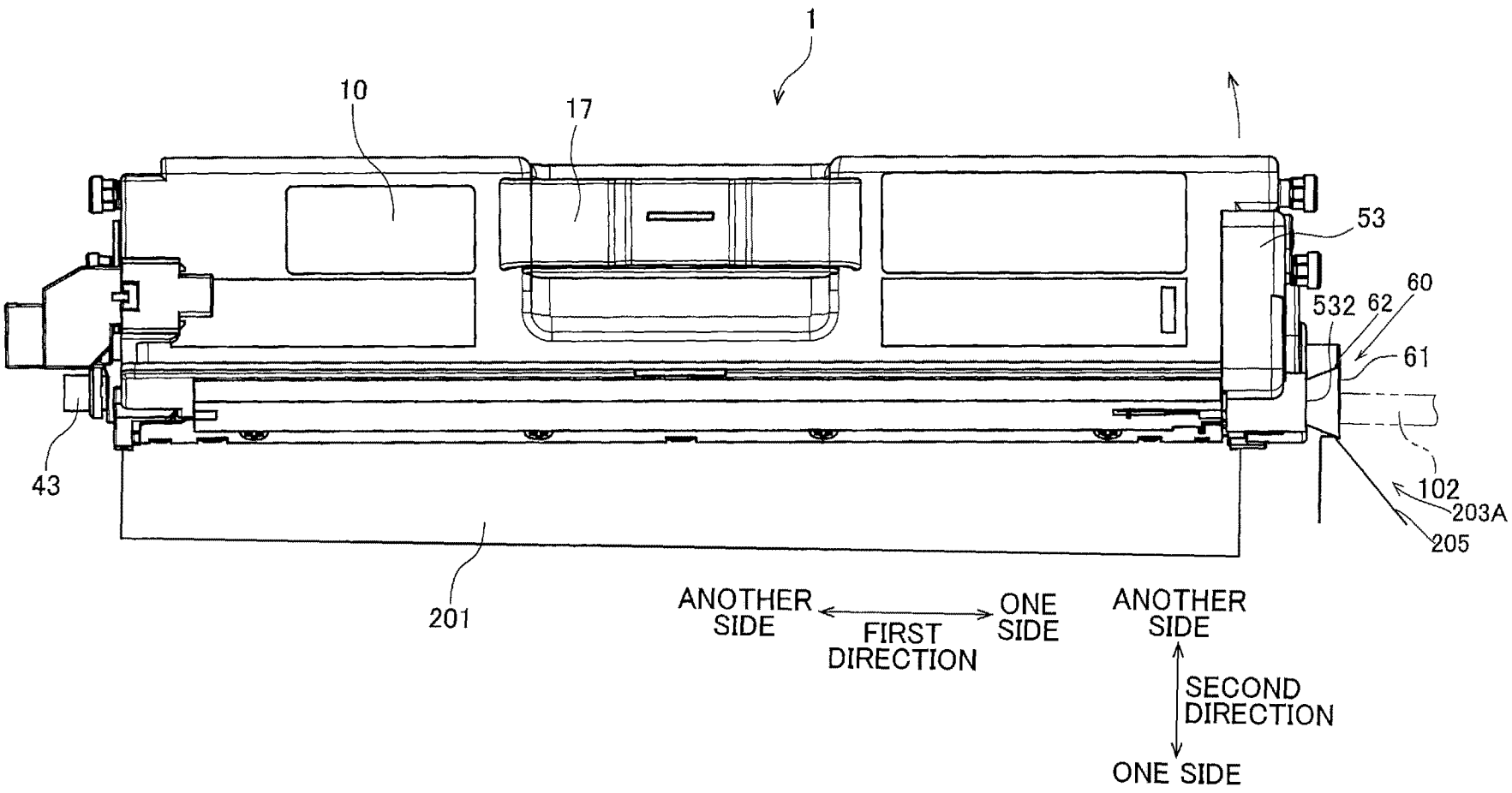
FIG. 9 is a view of the developing cartridge according to the embodiment and the photosensitive drum as viewed in the direction from the other side toward the one side in the third direction, in a state where the developing cartridge is at a separated position.

As shown in FIGS. 2, 7 and 9, the drum cartridge 2 has a receiving surface 205 for each slot 2A. The receiving surface 205 is positioned at one end portion of each slot 2A in the first direction.

Each receiving surface 205 is positioned at each recessed portion 203A formed at the first side frame 203. The receiving surface 205 is inclined relative to the first direction. More specifically, the receiving surface 205 is disposed such that the receiving surface 205 faces the cam 60 of the developing cartridge 1 attached to each slot 2A of the drum cartridge 2. The receiving surface 205 contacts a sloped surface 62 of the cam 60 as illustrated in FIG. 7. The receiving surface 205 is formed such that a distance between the receiving surface 205 and the developing cartridge 1 in the second direction increases in a direction from the second side frame 204 to the first side frame 203 in the first direction.

The drum cartridge 2 includes a pressure mechanism (not illustrated) for applying pressure in the direction from the other side to the one side in the second direction to the entire part of the casing 10 of the developing cartridge 1 in the first direction. For example, the amount of pressure applied to the casing 10 is uniform over the entire length of the casing 10 in the first direction.

<3. Overall Configuration of Developing Cartridge>

Figure 3:
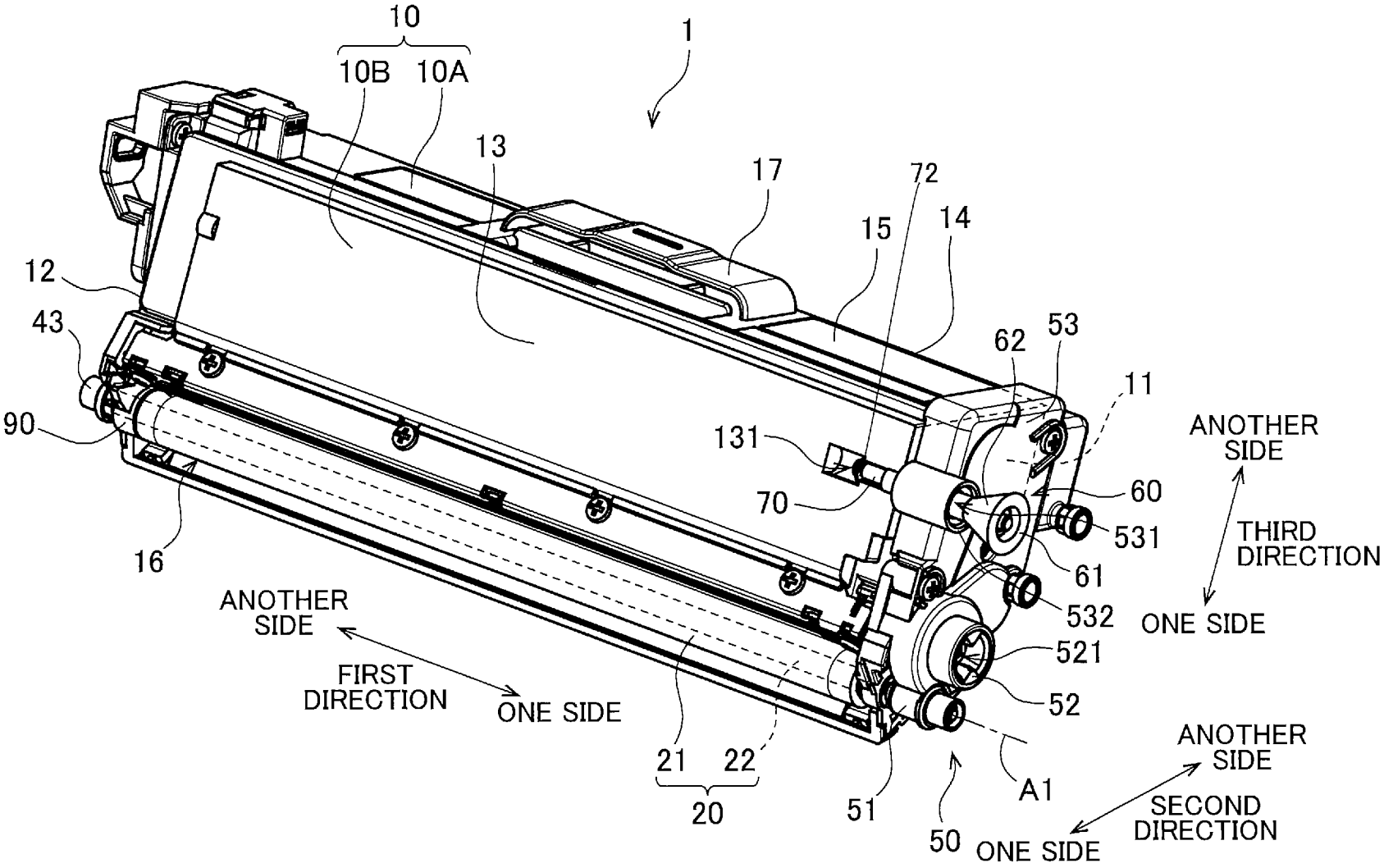
FIG. 3 is a perspective view of the developing cartridge according to the embodiment.
Figure 4:
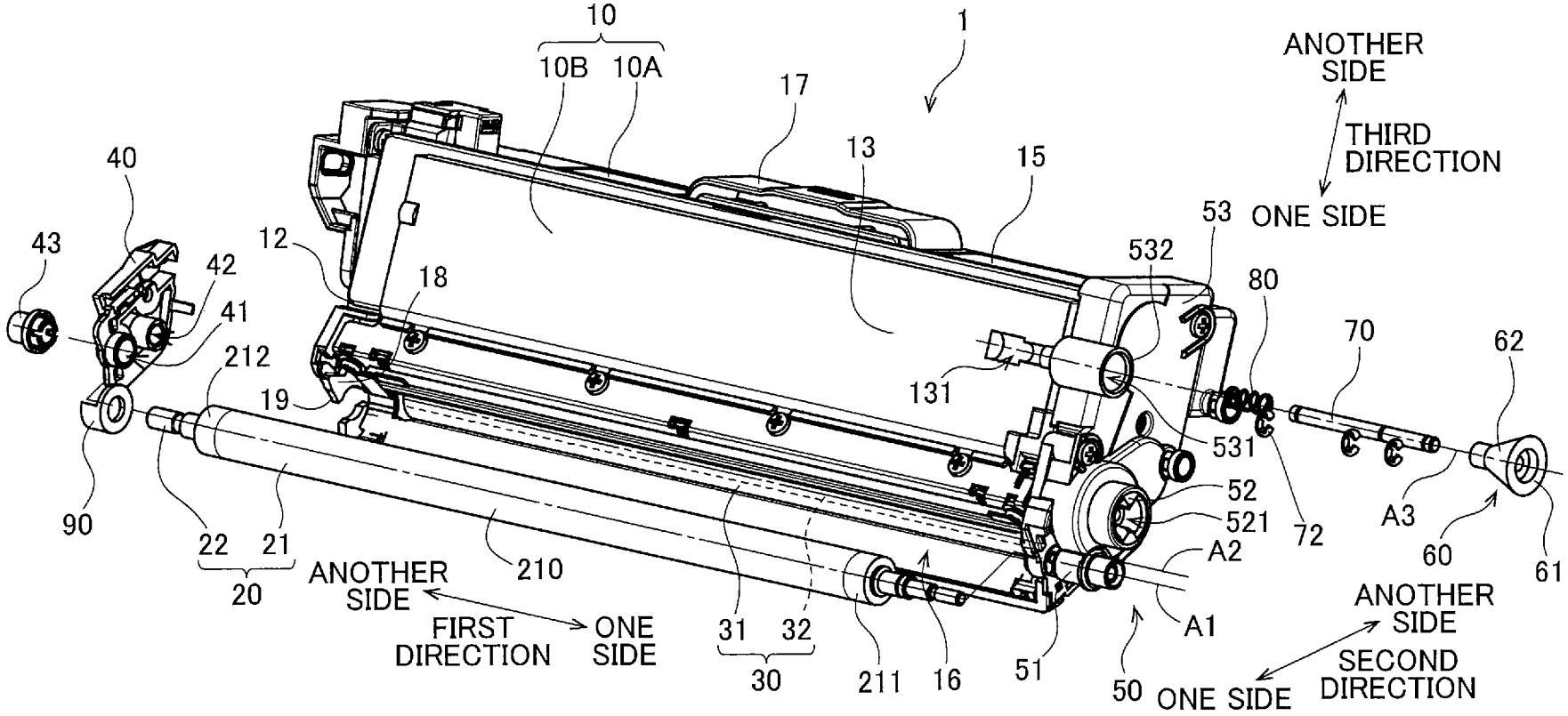
FIG. 4 is an exploded perspective view of the developing cartridge.

FIG. 3 is a perspective view of the developing cartridge 1. FIG. 4 is an exploded perspective view of the developing cartridge 1. As illustrated in FIGS. 3 and 4, the developing cartridge 1 includes the casing 10, the developing roller 20, a supply roller 30, a bearing 40, a gear portion 50, the cam 60, a shaft 70, a coil spring 80, and a ring 90.

The casing 10 is configured to accommodate therein developing agent. The casing 10 includes a container portion 10A and a lid portion 10B. The container portion 10A has an internal space in which the developing agent is accommodatable. The lid portion 10B is flat plate shaped. The lid portion 10B covers an opening portion at one end portion in the second direction of the container portion 10A. The developing agent is accommodated in the internal space surrounded by the container portion 10A and the lid portion 10B. An agitator (not illustrated) is positioned inside the casing 10 to agitate developing agent accommodated in the casing 10. The casing 10 has an opening 16 formed at one end portion in the third direction of the casing 10. The internal space of the casing 10 and an outside of the casing 10 are communicated with each other through the opening 16.

The casing 10 has a first outer surface 11 positioned at one end portion in the first direction of the casing 10. The casing has a second outer surface 12 positioned at another end portion in the first direction of the casing 10. The casing 10 has a third outer surface 13 positioned at the one end portion in the second direction of the casing 10. The casing has a fourth outer surface 14 positioned at another end portion in the second direction of the casing 10. The casing has a fifth outer surface 15 positioned at another end portion in the third direction of the casing 10. The container portion 10A has the first outer surface 11, the second outer surface 12, the fourth outer surface 14, and the fifth outer surface 15. The lid portion 10B has the third outer surface 13. A handle 17 is positioned at the fifth outer surface 15 for being gripped by a user. The first outer surface 11 is further in the direction from the other side to the one side in the first direction than the second outer surface 12.

The developing roller 20 is positioned at the opening 16 of the casing 10. The developing roller 20 is rotatable about the first axis A1 which is the rotation axis extending in the first direction. The developing roller 20 includes a developing roller body 21 and a developing roller shaft 22. The developing roller body 21 has a hollow cylindrical shape and extends in the first direction. The developing roller body 21 is made from elastic material such as rubber. The developing roller shaft 22 is a cylindrical columnar member extending throughout the developing roller body 21 in the first direction. The developing roller shaft 22 extends in the first direction along the first axis A1. The developing roller shaft 22 is made from metal or electrically conductive resin.

The developing roller body 21 is fixed to the developing roller shaft 22 so that the developing roller body 21 is unable to rotate relative to the developing roller shaft 22. That is, the developing roller body 21 is rotatable together with the developing roller shaft 22 about the first axis A1. A one end part of the outer circumferential surface of the developing roller body 21 in the second direction is exposed to the outside through the opening 16. Remaining part in the second direction of the outer circumferential surface of the developing roller body 21 is positioned inside the casing 10.

The developing roller shaft 22 has one end portion and another end portion in the first direction. The other end portion is positioned apart from the one end portion in the first direction. The developing roller body 21 is positioned between the one end portion and the other end portion in the first direction of the developing roller shaft 22. A developing roller gear 51 is attached to the one end portion of the developing roller shaft 22. The developing roller gear 51 is positioned at the first outer surface 11 of the casing 10. The developing roller gear 51 is fixed to the one end portion of the developing roller shaft 22 so that the developing roller gear 51 is unable to rotate relative to the developing roller shaft 22. Hence, rotation of the developing roller gear 51 causes rotation of the developing roller shaft 22 to rotate the developing roller body 21.

Incidentally, the developing roller shaft 22 may not extend through the developing roller body 21 in the first direction. For example, a developing roller shaft 22 may extend outward in the first direction from each end in the first direction of the developing roller body 21.

The supply roller 30 is positioned in the casing 10 at a position between the developing roller 20 and the agitator. The supply roller 30 is rotatable about a second axis A2 which is a rotation axis extending in the first direction. The supply roller 30 includes a supply roller body 31 and a supply roller shaft 32. The supply roller body 31 has a hollow cylindrical shape and extends in the first direction. The supply roller body 31 is made from elastic material such as rubber. The supply roller shaft 32 is a cylindrical columnar member extending throughout the supply roller body 31 in the first direction. The supply roller shaft 32 extends in the first direction along the second axis A2.

The supply roller body 31 is fixed to the supply roller shaft 32 so that the supply roller body 31 is unable to rotate relative to the supply roller shaft 32. That is, the supply roller body 31 is rotatable together with the supply roller shaft 32 about the second axis A2. The supply roller shaft 32 has one end portion and another end portion in the first direction. The supply roller body 31 is positioned between the one end portion and the other end portion in the first direction of the supply roller shaft 32. A supply roller gear (not illustrated) is attached to the one end portion of the supply roller shaft 32. The supply roller gear is positioned at the first outer surface 11 of the casing 10. The supply roller gear is fixed to the one end portion of the supply roller shaft 32 so that the supply roller gear is unable to rotate relative to the supply roller shaft 32. Hence, rotation of the supply roller gear causes rotation of the supply roller shaft 32 to rotate the supply roller body 31.

Incidentally, the supply roller shaft 32 may not extend through the supply roller body 31 in the first direction. For example, a supply roller shaft 32 may extend outward in the first direction from each end in the first direction of the supply roller body 31.

In accordance with application of driving force to the developing cartridge 1, developing agent accommodated in the casing 10 is supplied to the outer circumferential surface of the developing roller 20 via the supply roller 30. In this instance, the developing agent is subjected to triboelectric charging between the developing roller 20 and the supply roller 30. Further, developing bias voltage is applied to the developing roller shaft 22. Hence, developing agent is attracted to the outer circumferential surface of the developing roller body 21 due to electrostatic force between the developing roller shaft 22 and the developing agent.

As illustrated in FIGS. 3 and 4, the outer circumferential surface of the developing roller body 21 has a retaining region 210 on which developing agent is retainable, and a first non-retaining region 211 and a second non-retaining region 212 on which developing agent is unable to be retained. The retaining region 210 is in contact with the outer circumferential surface of the supply roller body 31. Hence, the developing agent is supplied from the outer circumferential surface of the supply roller body 31 to the retaining region 210 of the developing roller body 21. The first non-retaining region 211 is positioned further in a direction from the other side toward the one side in the first direction than the retaining region 210. The second non-retaining region 212 is positioned further in a direction from the one side toward the other side in the first direction than the retaining region 210. In other words, the first non-retaining region 211 is positioned at the one side in the first direction of the retaining region 210. The second non-retaining region 212 is positioned at the other side in the first direction of the retaining region 210. Specifically, the first non-retaining region 211 is closer to the first outer surface 11 than the retaining region 210 is to the first outer surface 11. The second non-retaining region 212 is closer to the second outer surface 12 than the retaining region 210 is to the second outer surface 12.

The developing agent retained on the retaining region 210 of the developing roller body 21 is supplied to the photosensitive drum 201 in the drum cartridge 2. In this case, the developing agent is transferred from the developing roller body 21 to the photosensitive drum 201 in conformity with an electrostatic latent image formed on the outer circumferential surface of the photosensitive drum 201. Thus, the electrostatic latent image becomes a visible image on the outer circumferential surface of the photosensitive drum 201.

The bearing 40 is positioned at the second outer surface 12 of the developing cartridge 1. The bearing 40 is fixed to the second outer surface 12 with, for example, screws. The bearing 40 has a first bearing through-hole 41 and a second bearing through-hole 42 each penetrating the entire thickness of the bearing 40 in the first direction. The other end portion in the first direction of the developing roller shaft 22 is inserted in the first bearing through-hole 41. Hence, the bearing 40 rotatably supports the other end portion of the developing roller shaft 22. The cartridge 1 further includes a collar 43. The collar 43 is attached to the other end portion of the developing roller shaft 22 at a position further in the direction from the one side toward the other side in the first direction than the bearing 40. In other words, the collar 43 is positioned farther from the second outer surface 12 than the bearing 40 is from the second outer surface 12 in the first direction. In other words, the bearing 40 is positioned between the developing roller body 21 and the collar 43 in the first direction. The other end portion in the first direction of the supply roller shaft 32 is inserted in the second bearing through-hole 42. Hence, the bearing 40 rotatably supports the other end portion of the supply roller shaft 32.

The gear portion 50 is positioned at the first outer surface 11 of the casing 10. The gear portion 50 includes the developing roller gear 51, the supply roller gear, the coupling 52, and a gear cover 53. The gear cover 53 constitutes an outer shell of the developing cartridge 1 along with the casing 10. Each of the developing roller gear 51, the supply roller gear, and the coupling 52 has at least a part positioned between the first outer surface 11 of the casing 10 and the gear cover 53 in the first direction.

The coupling 52 is a rotary member configured to receive driving force supplied from a power source in the image forming apparatus 100. The coupling 52 is rotatable about a rotation axis extending in the first direction. The coupling 52 has the fixing hole 521 recessed in the first direction. Upon attachment of the drum cartridge 2 to which the developing cartridge 1 is attached to the image forming apparatus 100, the transmission shaft of the image forming apparatus 100 is inserted in the fixing hole 521. Hence, the transmission shaft and the coupling 52 are coupled together so as not to rotate relative to each other. Accordingly, rotation of the transmission shaft causes rotation of the coupling 52, which causes rotation of the developing roller gear 51 along with the rotation of the developing roller 20. Further, rotation of the coupling 52 also causes rotation of the supply roller gear along with rotation of the supply roller 30.

The cam 60 is positioned at the one end portion in the first direction of the casing 10. In other words, the cartridge 1 has only one cam 60 that is positioned at the one end portion of the casing 10 in the first direction. No additional cam is provided at any other position, such as the other end portion of the casing 10 in the first direction. The cam 60 is movable relative to the casing 10 in the first direction between a first position and a second position. The second position is further in the direction from the one side toward the other side in the first direction than the first position. In other words, the second position is closer to the other end portion in the first direction of the casing 10 than the first position is to the other end portion. As illustrated in FIG. 4, the cam 60 has a conical shape whose center (a third axis A3) extends in the first direction. The cam 60 has an outer diameter gradually reduced as the outer diameter goes in the direction from the one side to the other side in the first direction. In other words, the outer diameter of the cam 60 is gradually reduced in a direction from the one side to the other side of the casing 10 in the first direction.

The cam 60 has a depressed surface 61 and a sloped surface 62. The depressed surface 61 is an end face of the cam 60 positioned at one end portion in the first direction of the cam 60. The depressed surface 61 extends perpendicularly to the first direction. The depressed surface 61 is configured to receive pressing force directed from the one side in the first direction of the casing 10 to the other side in the first direction of the casing. The sloped surface 62 is inclined with respect to the first direction, and extends conically about the third axis A3. A portion of the sloped surface 62 that is positioned opposite to the casing 10 with respect to the third axis A3 in the second direction is for contacting the receiving surface 205, and is positioned gradually away from the casing 10 in the second direction as the portion goes in the direction from the other side to the one side in the first direction.

The shaft 70 extends from the cam 60 in the direction from the one side to the other side in the first direction. Thus, the developing cartridge 1 is provided with only one shaft 70 that is positioned at the one end portion in the first direction of the casing 10. The shaft 70 is movable together with the cam 60 in the first direction. As illustrated in FIGS. 3 and 4, the gear cover 53 has a shaft accommodation through-hole 531 extending throughout the gear cover 53 in the first direction. Further, the third outer surface 13 of the casing 10 has a shaft accommodation groove 131 formed thereon. The shaft accommodation groove 131 is elongated from one end portion in the first direction of the lid portion 10B to extend in a direction toward another end portion in the first direction of the lid portion 10B. The shaft 70 is accommodated in the shaft accommodation through-hole 531 and the shaft accommodation groove 131.

The gear cover 53 has a seat surface 532 at one end portion in the first direction of the shaft accommodation through-hole 531. The seat surface 532 has an annular shape surrounding an opening formed at the one end portion in the first direction of the shaft accommodation hole 531. The sloped surface 62 of the cam 60 is positioned apart from the seat surface 532 in the direction from the other side toward the one side in the first direction in a case where the cam 60 is at the first position. The sloped surface 62 of the cam 60 is seated on the seat surface 532 in a case where the cam 60 is at the second position.

The coil spring 80 is positioned at the one end portion in the first direction of the casing 10. In other words, the developing cartridge 1 is provided with only one coil spring 80 at the one end portion in the first direction of the casing 10. The coil spring 80 is a resiliently deformable member expandable and shrinkable in the first direction. The coil spring 80 is accommodated in an interior of the shaft accommodation through-hole 531. The one end portion in the first direction of the coil spring 80 is connected to a washer 72 fitted to the other end portion of the shaft 70, and another end portion in the first direction of the coil spring 80 is connected to the casing 10.

The coil spring 80 is expandable and shrinkable in the first direction between its first length and its second length shorter than the first length. The coil spring 80 has the first length at the first position of the cam 60, and has the second length at the second position of the cam 60. The first length and the second length are smaller than a natural length of the coil spring 80. Hence, the coil spring 80 normally urges the cam 60 from the second position toward the first position.

The ring 90 is an annular component attached to the developing roller shaft 22. The ring 90 is positioned closer to the other end portion of the developing roller shaft 22 than the developing roller body 21 is to the other end portion of the developing roller shaft 22. Specifically, the ring 90 is positioned between the developing roller body 21 and the bearing 40 in the first direction. More specifically, the casing 10 has a side surface 18 at a distal end of the other end portion in the first direction of the casing 10. The side surface 18 faces in the direction from the other side to the one side in the first direction. That is, the side surface 18 faces inward in the first direction. The ring 90 is positioned between the developing roller body 21 and the side surface 18 in the first direction. In other words, the ring 90 is positioned inside of the developing cartridge 1 with respect to the side surface 18. On the other hand, the bearing 40 is positioned outside of the developing cartridge 1 with respect to the side surface 18.

Figure 5:
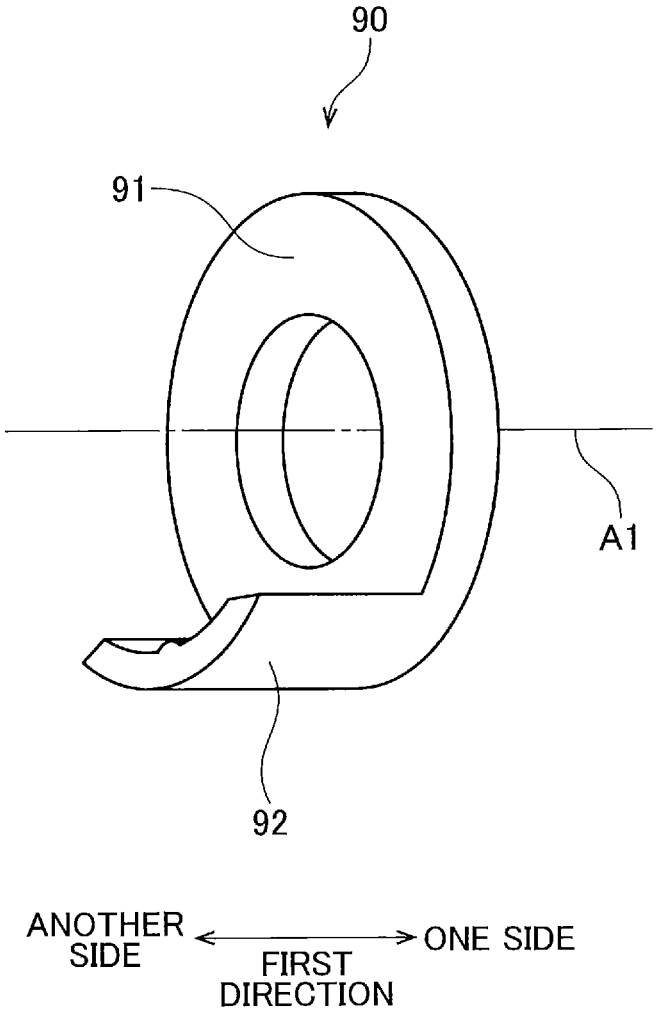
FIG. 5 is a perspective view of a ring which is provided in the developing cartridge according to the embodiment.

FIG. 5 is a perspective view of the ring 90. As illustrated in FIG. 5, the ring 90 includes a ring portion 91 and a pivot portion 92. The ring portion 91 has an annular shape whose center is coincident with the first axis A1. The developing roller shaft 22 is rotatably inserted in the ring portion 91. The pivot portion 92 protrudes from the ring portion 91 in the direction from the one side toward the other side in the first direction, that is, in the direction away from the developing roller body 21. The pivot portion 92 has an arcuate shape whose center is coincident with the first axis A1 when viewed in the first direction.

As shown in FIG. 4, the casing 10 has a rotation regulating surface 19 at the other end portion in the first direction of the casing 10. The rotation regulating surface 19 faces in the direction from the other side toward the one side in the second direction. The rotation regulating surface 19 is contactable with the pivot portion 92 of the ring 90 in a circumferential direction whose center is at the first axis A1. Thus, free rotation of the ring 90 relative to the developing roller shaft 22 is prevented. In this way, the pivot portion 92 can be always positioned further in the direction from the other side to the one side in the second direction than the developing roller shaft 22.

<4. Separating Operation>

The developing cartridge 1 performs separating operation by the driving force supplied from the image forming apparatus 100 after the developing cartridge 1 is attached to the drum cartridge 2 and the drum cartridge 2 is attached to the image forming apparatus 100. Through the separating operation, the developing roller 20 is temporarily separated from the photosensitive drum 201. For example, for performing monochromatic printing with the image forming apparatus 100, the developing cartridges 1 other than the color of black are subjected to the separating operation. However, the developing cartridge 1 of black color may be subjected to the separating operation.

In the following description, the position of the developing cartridge 1 contacting the photosensitive drum 201 will be referred to as "contacting position", and the position of the developing cartridge 1 separated from the photosensitive drum 201 will be referred to as "separated position".

Figure 6:
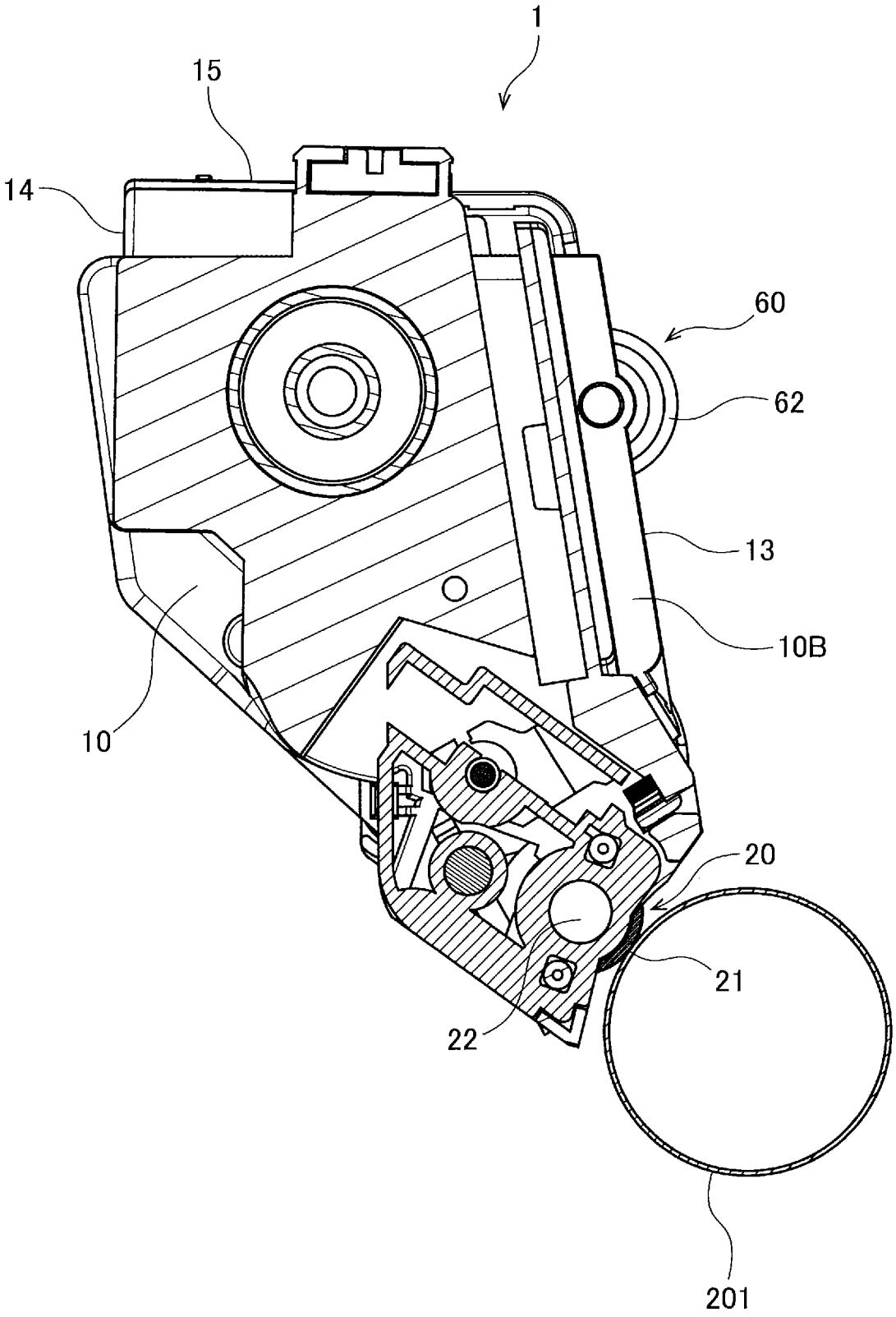
FIG. 6 is a cross-sectional view of the developing cartridge according to the embodiment and a photosensitive drum in a state where the developing cartridge is at a contacting position.
Figure 10:
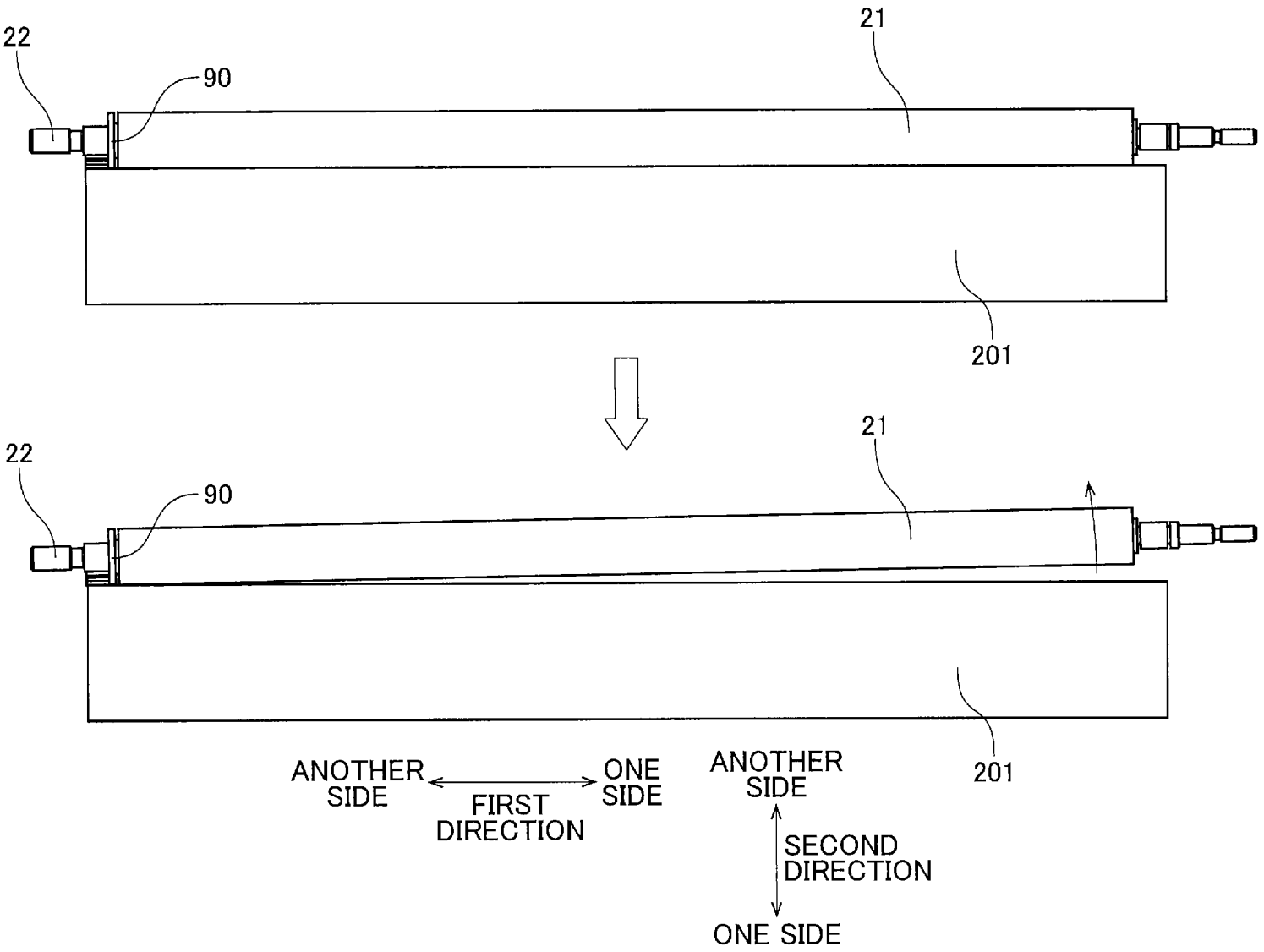
FIG. 10 is a view for description of movement of a developing roller with respect to the photosensitive drum.

FIG. 6 is a cross-sectional view of the developing cartridge 1 and the photosensitive drum 201 in a state where the developing cartridge 1 is at the contacting position. FIG. 6 illustrates the cross section perpendicular to the first direction. FIG. 7 is a view of the developing cartridge 1 and the photosensitive drum 201 as viewed in the direction from the other side toward the one side in the third direction, in the state where the developing cartridge 1 is at the contacting position. FIG. 9 is a view of the developing cartridge 1 and the photosensitive drum 201 as viewed in the direction from the other side toward the one side in the third direction, in a state where the developing cartridge 1 is at the separated position. FIG. 10 shows how the developing roller 20 moves with respect to the photosensitive drum 201.

Figure 8:
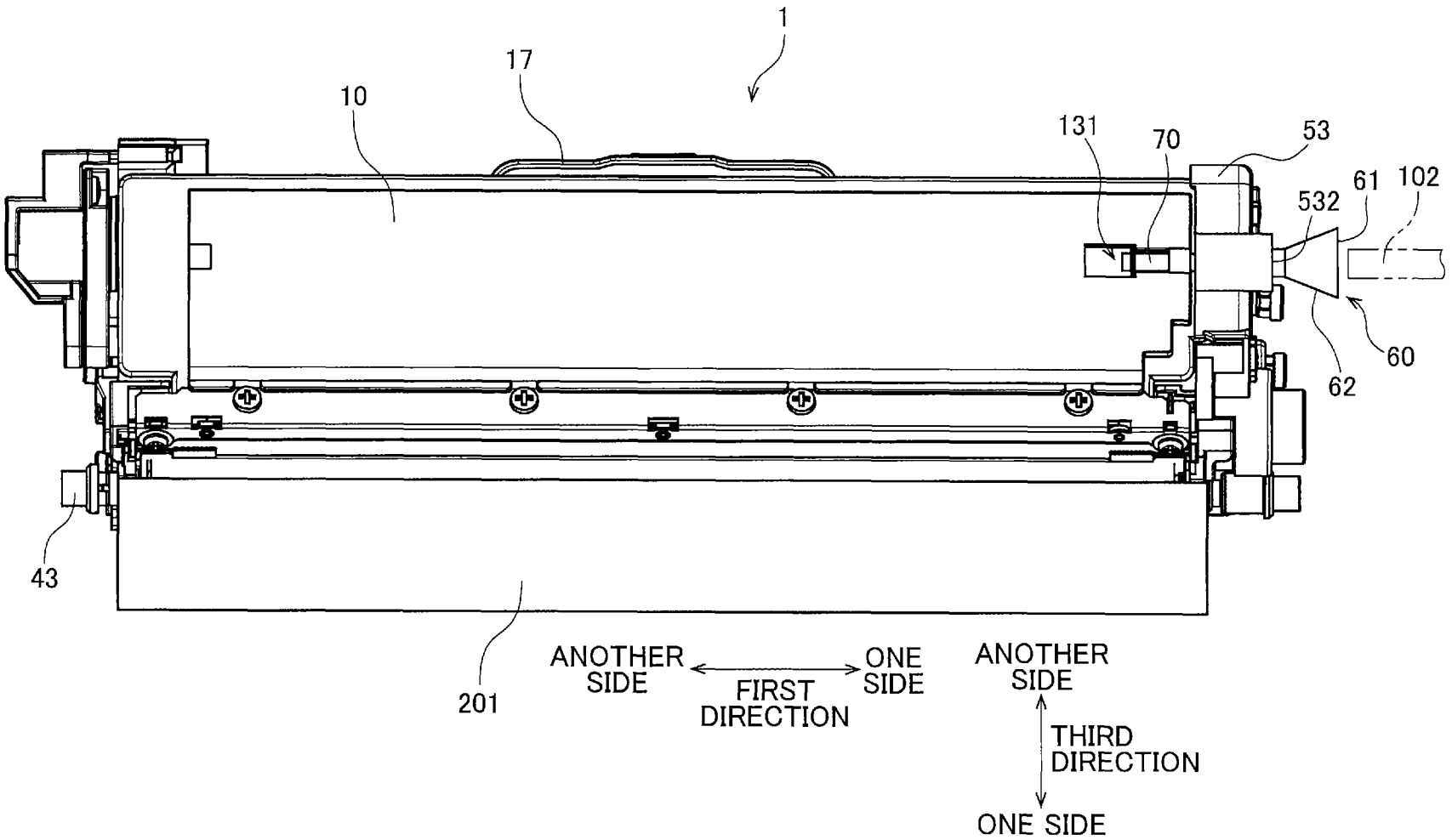
FIG. 8 is a view of the developing cartridge according to the embodiment and the photosensitive drum as viewed in a direction from one side toward another side in a second direction, in the state where the developing cartridge is at the contacting position.

As described above, the pressure mechanism (not illustrated) provided in the drum cartridge 2 is configured to press the casing 10 of the developing cartridge 1 in the direction from the other side to the one side in the second direction. In accordance with attachment of the developing cartridge 1 to the drum cartridge 2, the casing 10 is pressed by the pressure mechanism. Accordingly, the outer circumferential surface of the developing roller 20 is pressed against the outer circumferential surface of the photosensitive drum 201 by the pressing force of the pressure mechanism as illustrated in FIGS. 6 through 8 and an upper half portion in FIG. 10. An outer surface of the pivot portion 92 of the ring 90 is also pressed against the outer circumferential surface of the photosensitive drum 201 as illustrated in the upper portion of FIG. 10. At the initial stage where the developing cartridge 1 is attached to the drum cartridge 2, the cam 60 is at the first position. As illustrated in FIG. 7, the sloped surface 62 of the cam 60 contacts the receiving surface 205. More precisely, at the time of attachment of the developing cartridge 1 to the drum cartridge 2, the sloped surface 62 confronts the receiving surface 205 in the second direction, but is apart from the receiving surface 205 in the second direction. Then, as the cam 60 moves by a predetermined distance in the direction from the one side to the other side in the first direction, the sloped surface 62 is brought into contact with the receiving surface 205. Incidentally, the sloped surface 62 may contact the receiving surface 205 at the time of attachment of the developing cartridge 1 to the drum cartridge 2.

The image forming apparatus 100 includes four drive shafts 102 (FIG. 7) each extending in the first direction for applying the driving force to the cam 60 of each developing cartridge 1 attached to the drum cartridge 2 mounted in the image forming apparatus 100. Each drive shaft 102 has a cylindrical columnar shape or a prismatic columnar shape. Each drive shaft 102 is movable in the first direction. In a state where the drum cartridge 2 to which the developing cartridge 1 is attached is attached to the image forming apparatus 100, the one end portion in the first direction of the cam 60 becomes positioned opposing the drive shaft 102 through the through-hole 203B. A tip end of the drive shaft 102 is normally positioned apart from the cam 60 in the first direction. For performing separating operation, the image forming apparatus 100 moves the drive shaft 102 in the direction from the one side to the other side in the first direction. Hence, as illustrated in FIG. 9, the tip end of the drive shaft 102 presses against the depressed surface 61 of the cam 60. Accordingly, the cam 60 moves relative to the casing 10 in the direction from the one side toward the other side in the first direction against the urging force of the coil spring 80. In this way, the cam 60 is moved from the first position to the second position. As shown in FIGS. 7 and 9, when the cam 60 moves from the first position to the second position, the developing cartridge 1 is pivotally moved around the pivot portion 92 that is contact with the photosensitive drum 201.

Figure 11:
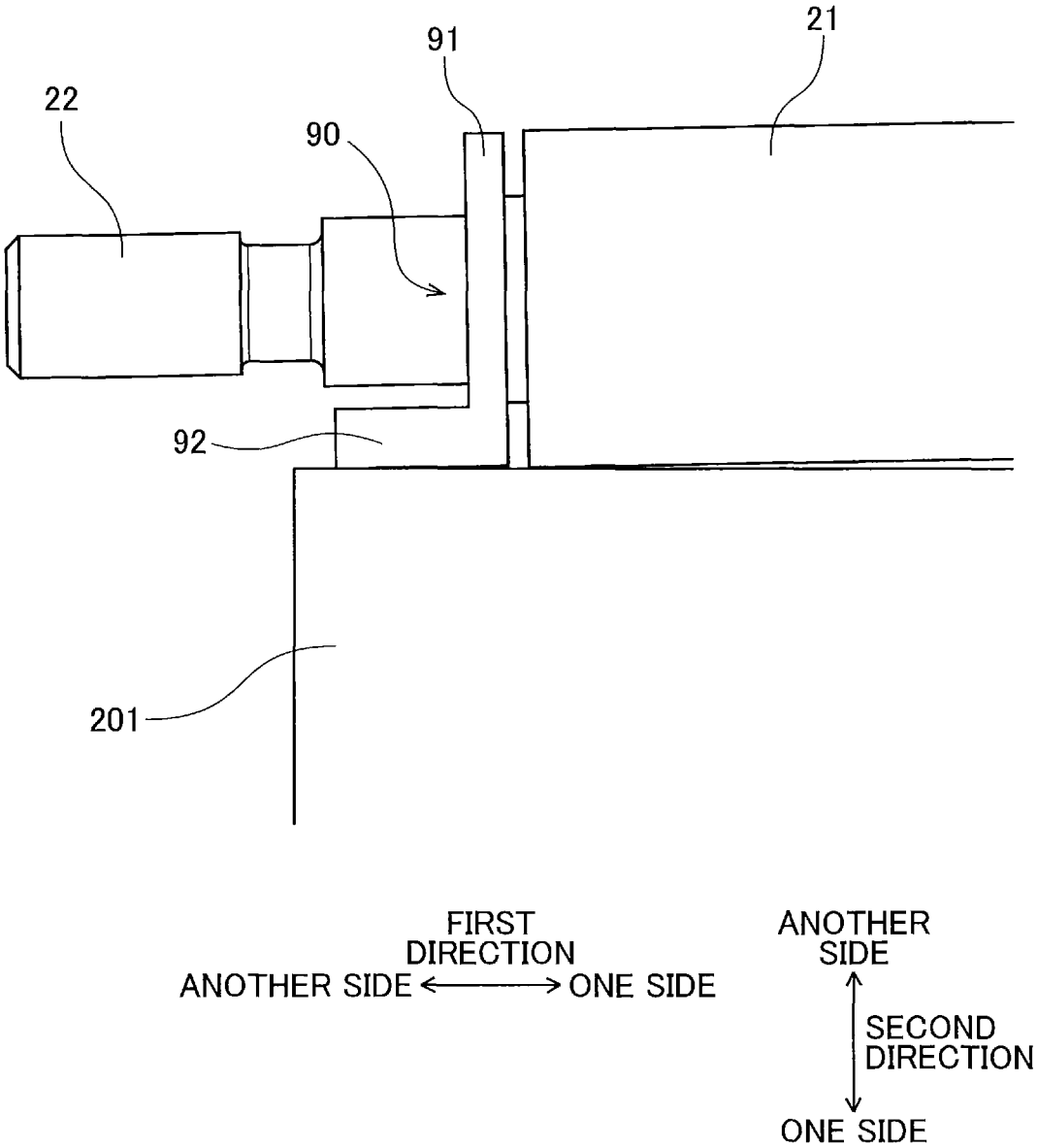
FIG. 11 is an enlarged view illustrating a vicinity of another end portion of the developing roller in a first direction.

More specifically, while the cam 60 is moved from the first position to the second position, the sloped surface 62 of the cam 60 contacts the receiving surface 205 of the drum cartridge 2. The sloped surface 62 is formed such that the sloped surface 62 extends radially outward of the shaft 70 and is inclined with respect to the first direction such that the distance of the sloped surface 62 from the shaft 70 increases in the direction from the other side to the one side in the first direction. Accordingly, when the cam 60 moves in the direction from the one side to the other side the in the first direction while the sloped surface 62 of the cam 60 is being in contact with the receiving surface 205, a portion of the sloped surface 62 that contacts the receiving surface 205 recedes from the shaft 70 in the radial direction of the shaft 70. That is, when the sloped surface 62 moves in the direction from the one side to the other side in the first direction, the sloped surface 62 moves also in a direction away from the receiving surface 205 in the second direction, as illustrated in FIG. 9. Thus, the cam 60 and the shaft 70 move in the direction away from the receiving surface 205 in the second direction. When the cam 60 finally reaches the second position, the sloped surface 62 is brought into contact with the seat surface 532 of the gear cover 53 around the shaft accommodation hole 531. As the shaft 70 and the cam 60 thus move in the direction away from the receiving surface 205 in the second direction, the one end portion in the first direction of the developing cartridge 1 moves together with the cam 60 and the shaft 70 in the direction away from the receiving surface 205 in the second direction against the pressing force applied to the one end portion of the developing cartridge 1 from the pressure mechanism, while a tip end portion in the first direction of the pivot portion 92 of the ring 90 continues contacting the photosensitive drum 201 due to the pressing force applied to the other end portion of the developing cartridge 1 from the pressure mechanism. Accordingly, the entire developing cartridge 1 including the casing 10 and the developing roller 20 is pivotally moved about the tip end portion of the pivot portion 92 in the counterclockwise direction in FIG. 10. As a result, the developing roller 20 is separated from the photosensitive drum 201 as illustrated in FIG. 9, the lower portion of FIG. 10, and FIG. 11.

Then, for terminating the separating operation, the image forming apparatus 100 moves the drive shaft 102 back in the first direction from the other side toward the one side in the first direction. The sloped surface 62 of the cam 60 becomes separated from the seat surface 532 of the gear cover 53. The cam 60 moves from the second position back to the first position by the urging force of the coil spring 80. As a result, the one end portion in the first direction of the developing cartridge 1 moves in the direction from the other side toward the one side in the second direction by the pressing force applied from the pressure mechanism. Hence, the entire developing cartridge 1 including the casing 10 and the developing roller 20 is pivotally moved in the opposite direction (clockwise direction in FIG. 10) about the tip end portion of the pivot portion 92 of the ring 90. As a result, the outer circumferential surface of the developing roller 20 is again brought into contact with the outer circumferential surface of the photosensitive drum 201. Finally, the tip end of the drive shaft 102 becomes separated from the cam 60 in the first direction.

As described above, in the developing cartridge 1 according to the embodiment, the casing 10 and the developing roller 20 are pivotally moved about the other end in the first direction of the developing cartridge 1 in a case where the cam 60 moves relative to the casing 10 in the direction from the one side toward the other side in the first direction, while being in contact with the receiving surface 205 of the drum cartridge 2. Therefore, the separation of the developing roller 30 from the photosensitive drum 21 can be performed by a driving force applied only to the one side in the first direction of the developing cartridge 1. Application of a driving force to both sides in the first direction of the developing cartridge 1 is unnecessary.

In particular, in the present embodiment, the ring 90 includes the pivot portion 92 extending from the ring portion 91 in the direction from the one side toward the other side in the first direction. The casing 10 and the developing roller 20 are pivotally moved about the tip end portion of the pivot portion 92. With this structure, a length from the pivot center, i.e., the tip end portion of the pivot portion 92 to the developing roller body 21 in the first direction can be increased. Thus, the entire developing roller body 21 can be largely separated from the photosensitive drum 201 in the second direction.

<5. Modifications>

Various modifications are conceivable. The following description mainly pertains to difference between the modification and the above-described embodiment.

<5-1. First Modification>

Figure 12:
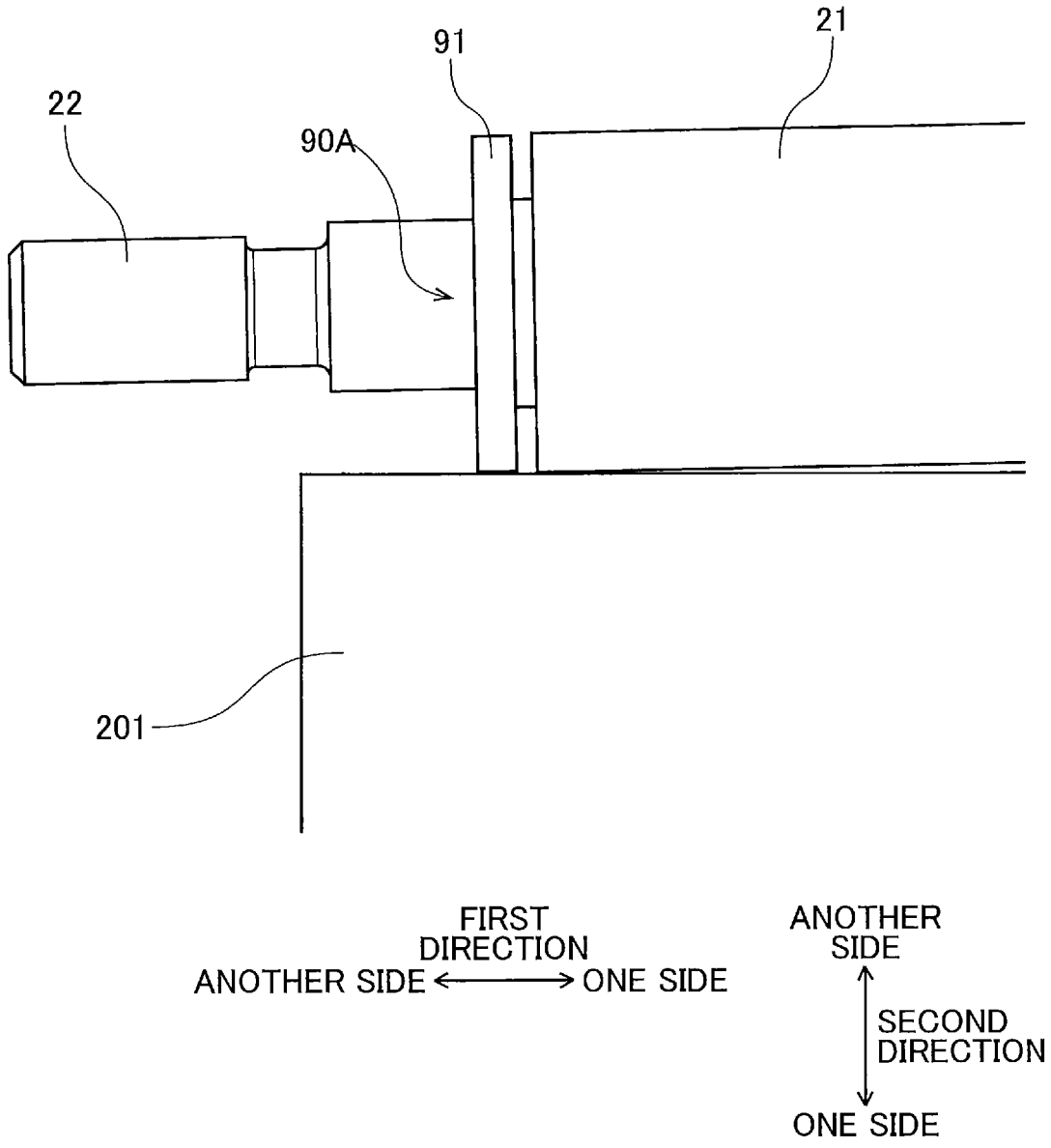
FIG. 12 is an enlarged view illustrating a vicinity of another end portion of a developing roller in a first direction in a developing cartridge according to a first modification.

FIG. 12 is an enlarged view illustrating the vicinity of another end portion of a developing roller 20 in the first direction in a developing cartridge 1 according to a first modification. As illustrated in FIG. 12, according to the first modification, a shape of a ring 90A is different from the shape of the ring 90 of the above-described embodiment. That is, the ring 90A does not include the pivot portion 92, but includes the ring portion 91 only. The ring portion 91 has a one end portion and another end portion that is further in the direction from the one side to the other side in the first direction. With this structure, an outer edge of the other end portion of the ring portion 91 in the first direction serves as a pivot center. More specifically, while the other edge of the other end portion of the ring portion 91 is in contact with the outer circumferential surface of the photosensitive drum 201 due to the application of pressing force from the pressure mechanism (not shown) to the developing cartridge 1, the casing 10 and the developing roller 20 are pivotally moved about the outer edge of the other end portion of the ring portion 91 in accordance with the movement of the cam 60 relative to the receiving surface 205 that is caused by the pressing force from the drive shaft 102.

With the structure according to the first modification, the ring 90A can have a simplified shape in comparison with the above-described embodiment, and the ring 90A has a length in the first direction smaller than the length of the ring 90 of the above-described embodiment.

<5-2. Second Modification>

Figure 13:
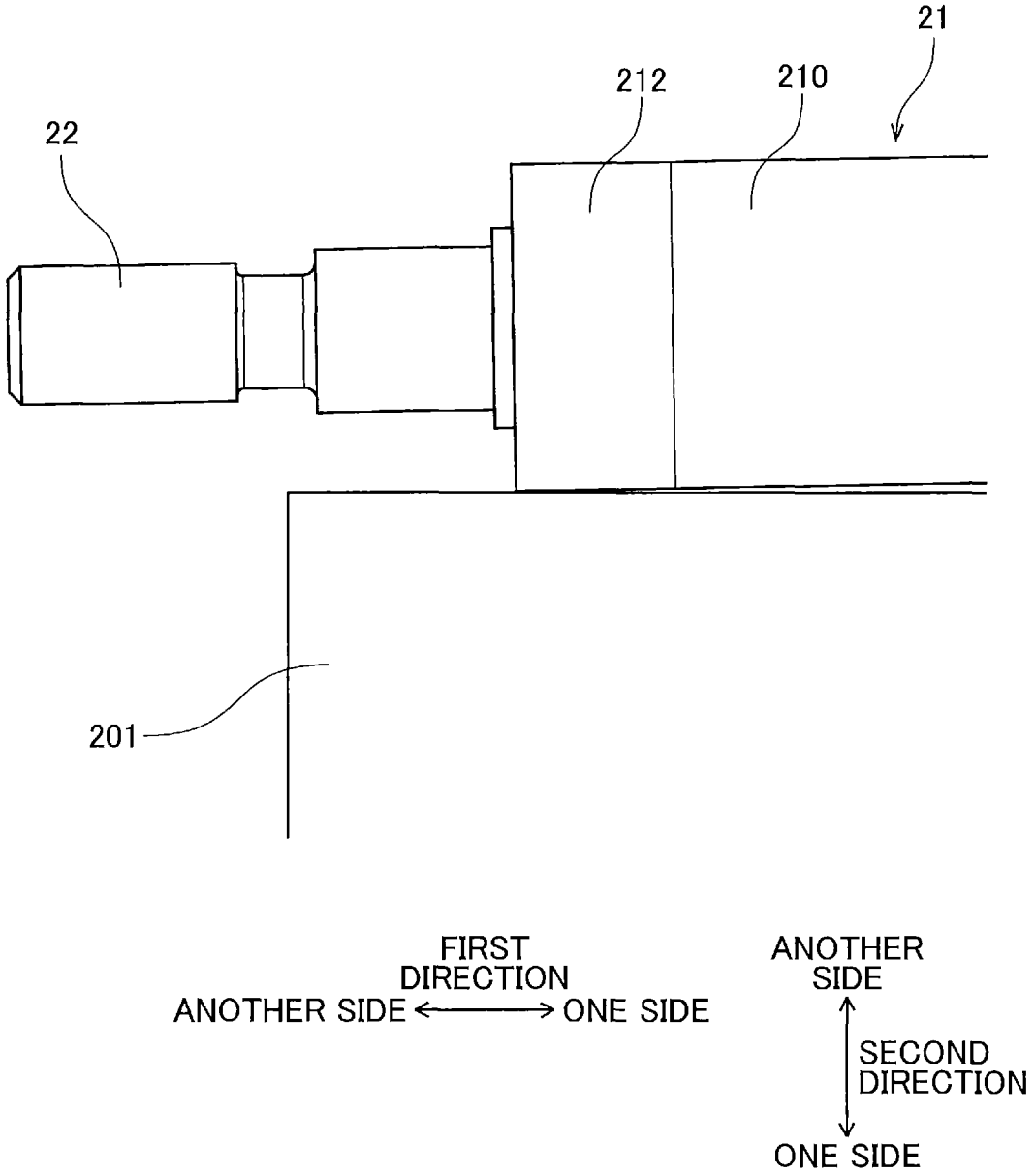
FIG. 13 is an enlarged view illustrating a vicinity of another end portion of a developing roller in a first direction in a developing cartridge according to a second modification.

FIG. 13 is an enlarged view illustrating the vicinity of another end portion of a developing roller 20 in the first direction in a developing cartridge 1 according to a second modification. The second modification illustrated in FIG. 13 is different from the above-described embodiment in that the developing cartridge 1 in the second embodiment is not provided with the ring 90. With this structure, an outer edge of the other end portion in the first direction of the developing roller body 21 serves as a pivot center. More specifically, while the outer edge of the other end portion in the first direction of the developing roller body 21 is in contact with the outer circumferential surface of the photosensitive drum 201 due to the application of pressing force from the pressure mechanism to the developing cartridge 1, the casing 10 and the developing roller 20 are pivotally moved about the outer edge of the developing roller body 21 in accordance with the movement of the cam 60 relative to the receiving surface 205 that is caused by the pressing force from the drive shaft 102.

The outer edge of the other end portion in the first direction of the developing roller body 21 that contacts the photosensitive drum 201 is a part of the second non-retaining region 212 on which developing agent is not retained. The retaining region 210 in its entirety can be separated away from the photosensitive drum 201 by pivotally moving the developing roller 20 about the outer edge in the outer end portion of the developing roller body 21 in the first direction.

Further, according to the second modification, no discrete component which is separate from the developing roller 20 and is functioning as the pivotal center, such as the ring 90, is not required. Therefore, the numbers of parts and components in the developing cartridge 1 can be reduced.

<5-3 Third Modification>

Figure 14:
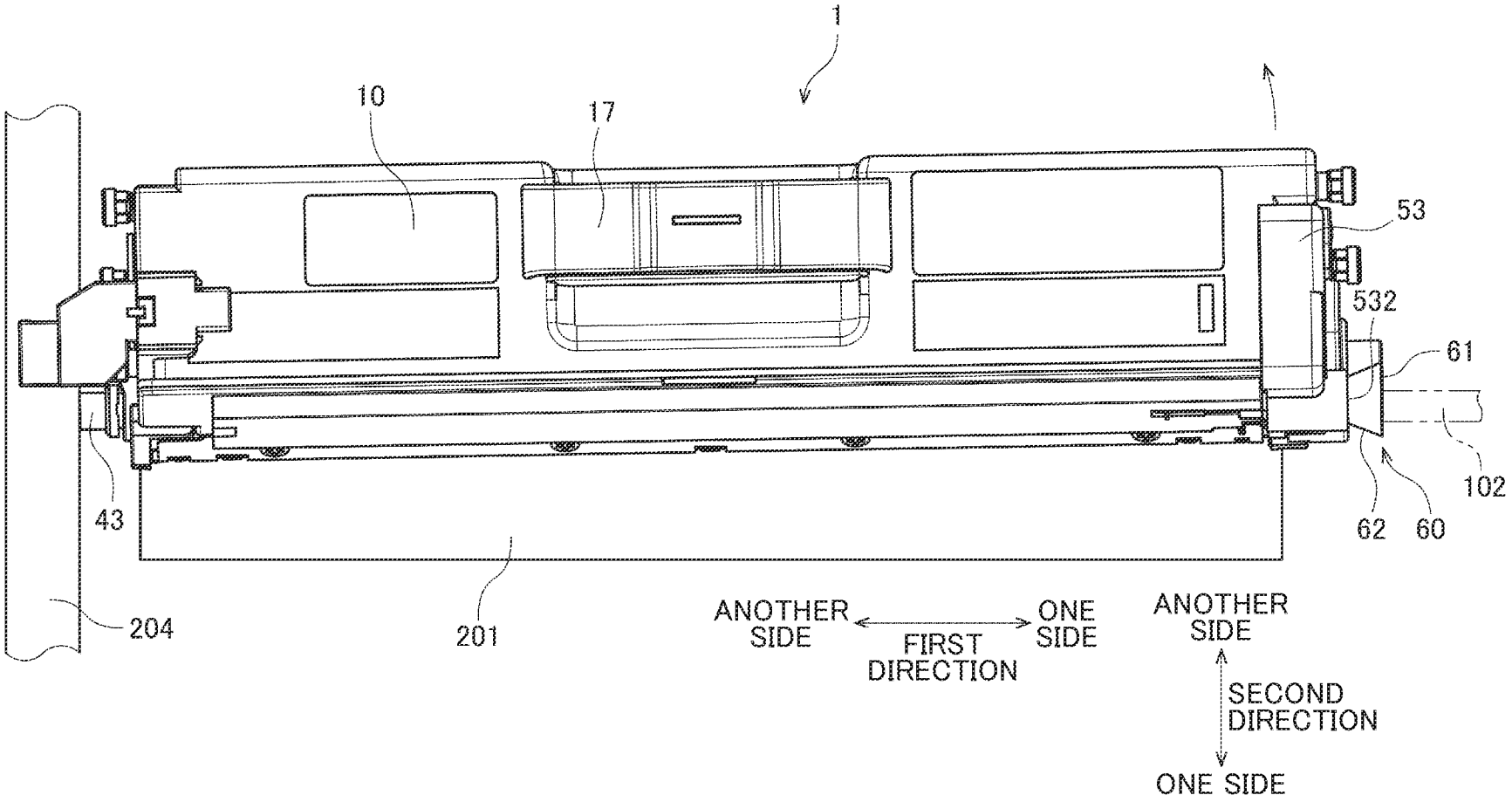
FIG. 14 is a view illustrating a developing cartridge according to a third modification, a photosensitive drum, and a second side frame as viewed in a direction from another side toward one side in a third direction.

FIG. 14 is a view illustrating a developing cartridge 20 according to a third modification, the photosensitive drum 201, and the second side frame 204 as viewed from the other side toward the one side in the third direction. A pivot center, about which the casing 10 and the developing roller 20 are pivotally moved during the separating operation in the third modification, is different from the pivot center in the above-described embodiment and modifications. As illustrated in FIG. 14, a part of the collar 43 is brought into contact with an inner surface of the second side frame 204 of the drum frame 202 in response to the attachment of the developing cartridge 1 to the drum cartridge 2. The casing 10 and the developing roller 20 are pivotally moved about the contacting part of the collar 43 in accordance with the movement of the cam 60 relative to the receiving surface 205 that is caused by the pressing force from the drive shaft 102.

In summary, the pivot center of the casing 10 and the developing roller 20 can be a part of the developing cartridge 1, and both of the casing 10 and the developing roller 20 can be pivotally moved about the part of the developing cartridge 1, while the part of the developing cartridge 1 is in contact with a part of the drum cartridge 2.

<5-4 Other Modifications>

According to the above-described embodiment, the cam 60 having the depressed surface 61 and the sloped surface 62 is positioned at the one end portion in the first direction of the casing 10. However, only the depressed surface 61 can be positioned at the one end portion in the first direction of the casing 10, and the sloped surface 62 can be positioned at the other end portion in the first direction of the casing 10. For example, the shaft 70 may be long enough to connect the depressed surface 61 at the one end portion of the developing cartridge 1 with the sloped surface 62 at the other end portion of the developing cartridge 1. In this case, the receiving surface 205 is positioned at the second side frame 204 such that the sloped surface slides on the receiving surface 205 in response to the application of the pressure to the depressed surface 61 from the drive shaft 102.

Further, in the above-described embodiment, the other end portion in the first direction of the developing cartridge 1 is in contact with the drum cartridge 2 so that the other end portion functions as the pivot center. However, the one end portion in the first direction of the developing cartridge 1 may be in contact with the drum cartridge 2 so that the one end portion functions as the pivot center. In this case, the cam 60 may be positioned at the other end portion of the developing cartridge 1 in the first direction.

Further, detailed configuration of the developing cartridge 1 may be different from that illustrated in the drawings, and each component in the above-described embodiment and modifications may be suitably combined without any technical conflicts.

What is claimed is:

1. A developing cartridge attachable to a drum cartridge including a photosensitive drum, the developing cartridge comprising:

a developing roller rotatable about a first axis extending in a first direction, the developing roller being configured to be positioned at a contact position where the developing roller is in contact with the photosensitive drum, and being also configured to be positioned at a separated position where the developing roller is separated from the photosensitive drum;

a casing configured to accommodate therein developing agent; and a cam movable relative to the casing between a first position and a second position in the first direction, the second position being a position further in a direction from one side toward another side in the first direction than the first position, the cam having a sloped surface sloping with respect to the first direction;

wherein in a state of attachment of the developing cartridge to the drum cartridge, the developing roller is positioned at the contact position at the first position of the cam, a portion of the developing cartridge is in contact with the drum cartridge and functions as a pivot center so that the casing and the developing roller are pivotally moved about the pivot center when the cam is moved from the first position to the second position, and the developing roller is positioned at the separated position at the second position of the cam.

2. The developing cartridge according to claim 1, wherein the casing has one end portion and another end portion in the first direction, the another end portion being further in a direction from the one side to the another side in the first direction than the one end portion;

the developing cartridge further comprising a depressed surface positioned at the one end portion of the casing, the depressed surface being configured to receive pressing force directing in a direction from the one side toward the another side in the first direction.

3. The developing cartridge according to claim 2, wherein in the attached state of the developing cartridge to the drum cartridge, the developing roller is at the contact position in a case where the depressed surface does not receive pressing force, and the developing roller is at the separated position in a case where the depressed surface receives pressing force.

4. The developing cartridge according to claim 2, wherein the cam has the depressed surface.

5. The developing cartridge according to claim 4, further comprising a shaft extending from the cam in a direction from the one side toward the another side in the first direction;

wherein in the attached state of the developing cartridge to the drum cartridge, the cam and the shaft are moved relative to the casing in a direction from the one side toward the another side in the first direction in the case where the depressed surface receives pressing force.

6. The developing cartridge according to claim 1, wherein the sloped surface is sloped away from the casing in a second direction crossing the first direction as the sloped surface goes in a direction from the another side toward the one side in the first direction.

7. The developing cartridge according to claim 6, wherein the second direction is perpendicular to the first direction.

8. The developing cartridge according to claim 1, wherein the cam has a conical shape such that an outer diameter of the cam is reduced as the outer diameter goes in the direction from the one side to the another side in the first direction.

9. The developing cartridge according to claim 1, wherein the casing has one end portion and another end portion in the first direction, the another end portion being further in a direction from the one side to the another side in the first direction;

wherein a seat surface is provided at the one end portion of the casing; and wherein the cam is separated from the seat surface in the first direction at the first position of the cam, and the cam is seated on the seat surface at the second position of the cam.

10. The developing cartridge according to claim 9, wherein the seat surface is annular in shape.

11. The developing cartridge according to claim 1, further comprising a resilient member urging the cam in a direction from the second position to the first position in the first direction.

12. The developing cartridge according to claim 11, wherein the resilient member is a coil spring.

13. The developing cartridge according to claim 1, wherein the casing has one end portion and another end portion in the first direction, the another end portion being further in a direction from the one side to the another side in the first direction;

wherein the cam is positioned at the one end portion of the casing;

wherein the developing cartridge has one side portion and another side portion in the first direction, the one side portion being further in a direction from the another side to the one side in the first direction than the another side portion; and wherein in a state of attachment of the developing cartridge to the drum cartridge, the another side portion of the developing cartridge is in contact with the drum cartridge and functions as a pivot center so that the casing and the developing roller are pivotally moved about the pivot center when the cam is moved from the first position to the second position.

14. The developing cartridge according to claim 13, wherein the cam is positioned at the one end portion of the casing in the first direction, and no other cam is provided at the casing.

15. The developing cartridge according to claim 13, wherein the developing roller comprises:

a developing roller shaft extending in the first direction along the first axis, the developing roller shaft having one end and another end apart from each other in the first direction, the another end of the developing roller shaft being further in a direction from the one side to the another side in the first direction than the one end of the developing roller shaft;

a developing roller body rotatable about the first axis together with the developing roller shaft, the developing roller body being positioned between the one end and the another end of the developing roller shaft;

wherein the developing cartridge further comprises a ring positioned closer to the another end of the developing roller shaft than the developing roller body is to the another end of the developing roller in the first direction, wherein in a state of attachment of the developing cartridge to the drum cartridge, a portion of the ring is in contact with the drum cartridge and functions as a pivot center so that the casing and the developing roller are pivotally moved about the pivot center when the cam is moved from the first position to the second position.

16. The developing cartridge according to claim 15, wherein in the attached state of the developing cartridge to the drum cartridge, the portion of the ring is in contact with the photosensitive drum.

17. The developing cartridge according to claim 15, wherein the ring comprises:

a ring portion in which the developing roller shaft is inserted; and a pivot portion extending from the ring portion in the direction from the one side toward the another side in the first direction, wherein in a state of attachment of the developing cartridge to the drum cartridge, a tip end portion of the pivot portion is in contact with the drum cartridge and functions as a pivot center so that the casing and the developing roller are pivotally moved about the pivot center when the cam is moved from the first position to the second position.

18. The developing cartridge according to claim 17, wherein the pivot portion has an arcuate shape whose center is coincident with the first axis.

19. The developing cartridge according to claim 18, wherein the casing has a rotation regulating surface that is contactable with the pivot portion of the ring in a circumferential direction about the first axis so as to regulate rotation of the ring relative to the casing.

20. The developing cartridge according to claim 15, further comprising a bearing positioned at the another end portion of the casing, the bearing rotatably supporting the developing roller shaft;

wherein the ring is positioned between the developing roller body and the bearing in the first direction.

21. The developing cartridge according to claim 20, further comprising a supply roller rotatable about a second axis extending in the first direction, the supply roller comprising:

a supply roller shaft extending in the first direction along the second axis; and a supply roller body rotatable about the second axis together with the supply roller shaft;

wherein the bearing rotatably supports the supply roller shaft.

22. The developing cartridge according to claim 15, wherein the casing has an inner side surface positioned at the another end portion thereof and facing inward in the first direction;

wherein the ring is positioned between the developing roller body and the inner side surface of the casing in the first direction.

23. The developing cartridge according to claim 13, wherein the developing roller comprises:

a developing roller shaft extending in the first direction along the first axis, the developing roller shaft having one end and another end apart from each other in the first direction, the another end of the developing roller shaft being further in a direction from the one side to the another side in the first direction than the one end of the developing roller shaft; and a developing roller body rotatable about the first axis together with the developing roller shaft, the developing roller body being positioned between the one end and the another end of the developing roller shaft, the developing roller body having one end portion and another end portion in the first direction, the one end portion being closer to the one end of the developing roller shaft than the another end portion is to the one end of the developing roller shaft, and the another end portion is closer to the another end of the developing roller shaft than the one end portion is to the another end of the developing roller shaft;

wherein in a state of attachment of the developing cartridge to the drum cartridge, the another end portion of the developing roller body is in contact with the drum cartridge and functions as a pivot center so that the casing and the developing roller are pivotally moved about the pivot center when the cam moves from the first position to the second position.

24. The developing cartridge according to claim 23, wherein in the attached state of the developing cartridge to the drum cartridge, the another end portion of the developing roller body is in contact with the photosensitive drum and functions as the pivot center.

25. The developing cartridge according to claim 23, wherein the developing roller body has an outer circumferential surface having a retaining region on which the developing agent is retainable and a non-retaining region on which the developing agent is not retainable, the non-retaining region being positioned further in the direction from the one side to the another side in the first direction than the retaining region, the non-retaining region including the another end portion of the developing roller body.

26. The developing cartridge according to claim 1, wherein the drum cartridge includes a drum frame configured to rotatably support the photosensitive drum;

wherein in the attached state of the developing cartridge to the drum cartridge, the portion of the developing cartridge is in contact with the drum frame and functions as the pivot center such that the developing cartridge is pivotally moved about the pivot center when the cam moves from the first position to the second position.

* * * * *